US010155913B2

(12) United States Patent
Frasier

(10) Patent No.: US 10,155,913 B2
(45) Date of Patent: Dec. 18, 2018

(54) SYSTEMS AND METHODS FOR MANUFACTURING EMULSIFIED FUEL

(71) Applicant: Next Alternative Inc., Chandler, AZ (US)

(72) Inventor: Micheal Jacob Frasier, Phoenix, AZ (US)

(73) Assignee: Next Alternative Inc., Chandler, AZ (US)

( * ) Notice: Subject to any disclaimer, the term of this patent is extended or adjusted under 35 U.S.C. 154(b) by 0 days.

(21) Appl. No.: 15/133,573

(22) Filed: Apr. 20, 2016

(65) Prior Publication Data

US 2017/0306256 A1 Oct. 26, 2017

(51) Int. Cl.

| | |
|---|---|
| ***C10L 1/32*** | (2006.01) |
| ***C10L 10/18*** | (2006.01) |
| *C10L 1/16* | (2006.01) |
| *C10L 1/198* | (2006.01) |
| *C10L 1/23* | (2006.01) |

(52) U.S. Cl.

CPC ..... *C10L 1/328* (2013.01); *C10L 10/18* (2013.01); *C10L 1/1616* (2013.01); *C10L 1/1985* (2013.01); *C10L 1/23* (2013.01); *C10L 2200/0259* (2013.01); *C10L 2200/0438* (2013.01); *C10L 2200/0446* (2013.01); *C10L 2230/14* (2013.01); *C10L 2250/084* (2013.01); *C10L 2290/24* (2013.01)

(58) Field of Classification Search

CPC combination set(s) only.

See application file for complete search history.

(56) References Cited

U.S. PATENT DOCUMENTS

| | | | | |
|---|---|---|---|---|
| 4,583,998 | A | 4/1986 | Reid et al. | |
| 2004/0111955 | A1 | 6/2004 | Mullay et al. | |
| 2005/0022445 | A1 | 2/2005 | Sarin et al. | |
| 2012/0167451 | A1* | 7/2012 | Festuccia | C10L 1/02 44/307 |
| 2012/0180741 | A1* | 7/2012 | Strey | C10L 1/328 123/1 A |

(Continued)

FOREIGN PATENT DOCUMENTS

| | | |
|---|---|---|
| WO | WO1999063024 | 12/1999 |
| WO | WO2012155413 | 11/2012 |

OTHER PUBLICATIONS

FSI Energy, "Discussion of Water-in-Oil Emulsion Combustion", http://fsienergy.com/H20INOIL.htm.

(Continued)

*Primary Examiner* — Ellen M McAvoy
*Assistant Examiner* — Chantel L Graham
(74) *Attorney, Agent, or Firm* — Jennings Strouss; Michael K. Kelly; Daniel R. Pote

(57) ABSTRACT

Methods and systems for manufacturing emulsified fuel include: adding surfactant to fuel; blending the surfactant and fuel together in a first mixing chamber for a first mixing period; subjecting the blended surfactant and fuel mixture to a dwell period following the first mixing period; introducing water into the blended surfactant and fuel mixture following the dwell period; and blending the surfactant, fuel and water together in a second mixing chamber for a second mixing period. The surfactant is selected to exhibit an HLB rating in the range of 8.75 to 8.83.

11 Claims, 3 Drawing Sheets

(56) References Cited

U.S. PATENT DOCUMENTS

| | | | |
|---|---|---|---|
| 2013/0036659 | A1 | 2/2013 | Moncrieff et al. |
| 2014/0202927 | A1 | 7/2014 | Tao et al. |

OTHER PUBLICATIONS

Mohammed, Y.K., et al., "Current Trends in Water-in-Diesel Emulsion as a Fuel", Hindawl Publishing Corporation, The Scientific World Journal, vol. 2014, Article ID 527472, 15pgs, http://www.hindawi.com/journals/tswj/2014/527472/.

Griffin, William C., "Classification of Surface-Active Agents by "HLB"", Journal of Cosmetic Science, vol. 1, No. 5, Dec. 1949, pp. 311-326.

Griffin, William C., "Calculation of HLB Values of Non-Ionic Surfactants", Journal of the Society of Cosmetic Chemists, May 1954, pp. 249-256.

Davies, J.T., "A Quantitative Kinetic Theory of Emulsion Type, I. Physical Chemistry of the Emulsifying Agent", Gas/Liquid and Liquid/Liquid Interfaces, Proceedings of 2nd International Congress Surface Activity, Butterworths, London 1957, pp. 426-438

Air Products—Tomadol Ethoxylated Alcohols http://www.airproducts.com/products/product-finder/product-list/tomadol-45-13.aspx?itemId=B39B5CE9CE5843C08CAEAB8BE73866C7&=tnhttp://www.airproducts.com/~/media/Files/PDF/industries/industrial-and-institutional-cleaning-tomadol-ethoxylated-alchohols-product-guide.pdf.

International Search Report, PCT/US17/027346 dated Jul. 17, 2017; 2pgs.

Written Opinion, PCT/US17/027346 dated Jul. 17, 2017; 6pgs.

* cited by examiner

SYSTEMS AND METHODS FOR MANUFACTURING EMULSIFIED FUEL

TECHNICAL FIELD

The present invention relates, generally, to systems and methods for manufacturing water-in-oil emulsified fuels and, more particularly, to a two-stage mixing process using a surfactant having a hydrophilic-lipophilic balance (HLB) value selected to promote complete combustion and extended shelf life.

BACKGROUND

An emulsified fuel is an emulsion composed of water and a combustible liquid, either oil or fuel. Emulsions are a specie of dispersions comprising a continuous and a dispersed phase, where both phases (oil and water) are immiscible liquids.

Water continuous (oil-in-water) emulsified fuels are sometimes referred to as high internal phase emulsions (hipe) because the continuous phase is around 30% of the composition of the fuel. Oil continuous (water-in-oil) emulsified fuels are exemplified by diesel (or biodiesel blended fuels) and water emulsions.

Water-in-oil emulsions have recently been engineered to control the stability and quality of the emulsion to make it advantageous for industrial and power-generating uses. (See, FSI Energy "Discussion of Water-in-Oil Emulsion Combustion" available at http://fsienergy.com/H20INOIL.htm, the entire contents of which are hereby incorporated by this reference). These water-in-oil emulsions are said to yield reduced carbon particulates, lower opacity, and lower nitrogen oxide levels.

In the combustion of a water-in-oil emulsion, the primary spray fuel droplets are further divided as a result of the explosive vaporization caused by rapid heating of the water dispersed within the individual fuel droplets. The internal water droplets undergo spontaneous nucleation of steam bubbles, causing a violent conversion of the water droplet to steam. The vaporization, in turn, produces a rapid expansion of the surrounding oil droplets, fragmenting the oil into a vast number of smaller fuel droplets in a process known as secondary atomization.

Presently known techniques for manufacturing water-in-oil emulsions involve the simultaneous mechanical agitation of the water and oil in the presence of surface active agents, referred to herein as emulsifiers or surfactants, to enhance the stability of the emulsion. (See Mohammed Yahaya Khan, Z. A. Abdul Karim, Ftwi Yohaness Hagos, A. Rashid A. Aziz, and Isa M. Tan "Current Trends in Water-in-Diesel Emulsion as a Fuel" available at http://www.hindawi.com/journals/tswj/2014/527472/, the entire contents of which are hereby incorporated by this reference).

Surfactants may be described as comprising a polar (hydrophilic) head and a nonpolar (hydrophobic) tail, and serve to weaken the surface tension, or intrinsic adhesion, of the host medium. When dissolved in an oil-water mixture, the polar groups orient toward the water and the nonpolar groups orient toward the oil to lower the interfacial tension between the oil and water phases. For this purpose, surfactants may be characterized by a hydrophilic-lipophilic balance or HLB (water liking-oil liking) score. In particular, Griffin's method generally expresses the HLB value for non-ionic surfactants as $$HLB=20*M_H/M$$

where $M_H$ is the molecular mass of the hydrophilic portion of the molecule, and M is the molecular mass of the entire molecule. (See Griffin, William C. (1949), "*Classification of Surface-Active Agents by 'HLB'*", Journal of the Society of Cosmetic Chemists; and Griffin, William C. (1954), "*Calculation of HLB Values of Non-Ionic Surfactants*", Journal of the Society of Cosmetic Chemists, the entire contents of which are hereby incorporated by this reference). Lower HLB values are more lipophilic and tend to promote water-in-oil-emulsions, while higher HLB values are more hydrophilic and tend to promote oil-in-water emulsions. Other methods may also be used to determine HLB values; See Davies J T (1957), "*A quantitative kinetic theory of emulsion type, I. Physical chemistry of the emulsifying agent*", Gas/Liquid and Liquid/Liquid Interface (Proceedings of the International Congress of Surface Activity), the entire contents of which are hereby incorporated by this reference).

Surfactants used in water-in-oil emulsions are generally selected to ensure that the water remains dispersed within the continuous oil phase, and thus tend to have lower HLB values, for example in the range of up to about 6. In contrast, surfactants used in oil-in-water emulsions are selected to ensure that the oil remains dispersed within the continuous water phase, and thus tend to have higher HLB values, for example in the range of 10 and above.

Presently known emulsified fuels are limited, however, in that they tend to have a limited shelf life; that is, they tend to separate after a few hours or days. Systems and methods are thus needed which overcome the limitations of the prior art.

Various features and characteristics will also become apparent from the subsequent detailed description and the appended claims, taken in conjunction with the accompanying drawings and this background section.

BRIEF SUMMARY

Various embodiments of the present invention relate to systems and methods for, inter alia: i) manufacturing an emulsion using a surfactant having an HLB rating in the range of about 8.5 to about 9; and ii) a two stage mixing process in which the fuel and surfactant are first mixed together and thereafter allowed to settle, followed by a second mixing stage in which water is added to the fuel/surfactant mixture.

It should be noted that the various inventions described herein, while illustrated in the context of a water-in-oil emulsion, are not so limited. Those skilled in the art will appreciate that the systems and methods described herein may contemplate any emulsion, including oil-in-water and multiphase formulations.

Various other embodiments, aspects, and features are described in greater detail below.

BRIEF DESCRIPTION OF THE DRAWING FIGURES

Exemplary embodiments will hereinafter be described in conjunction with the following drawing figures, wherein like numerals denote like elements, and:

DETAILED DESCRIPTION

The following detailed description of the invention is merely exemplary in nature and is not intended to limit the invention or the application and uses of the invention. Furthermore, there is no intention to be bound by any theory presented in the preceding background or the following detailed description.

Various embodiments of the present invention relate to systems and methods for manufacturing water-in-oil emulsified fuels using a formula which contains a surfactant having an optimum HLB rating of about 8.7 to 8.9. The present inventor has determined that this range promotes a substantially longer shelf life, allowing the dispersed water to remain in suspension for many months or even years. As a result, the fuel can be stored for extended periods, shipped remotely, and manufactured off-site, enabling applications which were unavailable for short shelf life formulations.

Another embodiment involves using a two stage manufacturing process in which the fuel and the surfactant are first mixed together and allowed to settle for a predetermined dwell time, to thereby prepare the mixture for the subsequent introduction of water. In this way, surface tension of the fuel is reduced, allowing water molecules to be interposed within the continuous phase oil, while maintaining a mid-range HLB rating to promote extended shelf life.

In accordance with a further aspect of the invention, an in-line heater may be used to raise the temperature of the emulsion prior to introducing it into the combustion chamber, to thereby facilitate auto-ignition. As a result, the need to switch back and forth between a non-emulsified and an emulsified diesel fuel may be avoided.

In yet a further embodiment, the emulsified fuel is treated with an appropriate nitrate to chemically lower the auto-ignition temperature of the emulsion.

Figure 1:
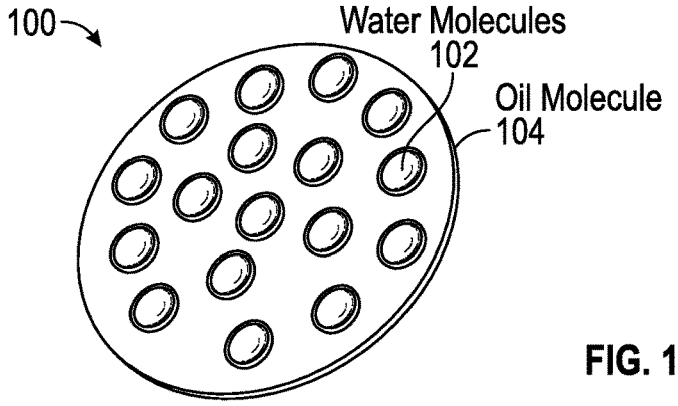
FIG. 1 is a schematic drawing of a water-in-oil emulsified fuel showing water molecules as the dispersed phase entrained within a continuous oil phase in accordance with various embodiments.

Referring now to FIG. 1, a water-in-oil emulsified fuel 100 manufactured in accordance with the techniques described herein may be modeled as a substantially homogeneous distribution of water molecules 102 dispersed within a continuous fuel phase 104. Various methodologies for manufacturing the water-in-oil emulsified fuel are described in greater detail below in conjunction with FIG. 4.

Figure 2:
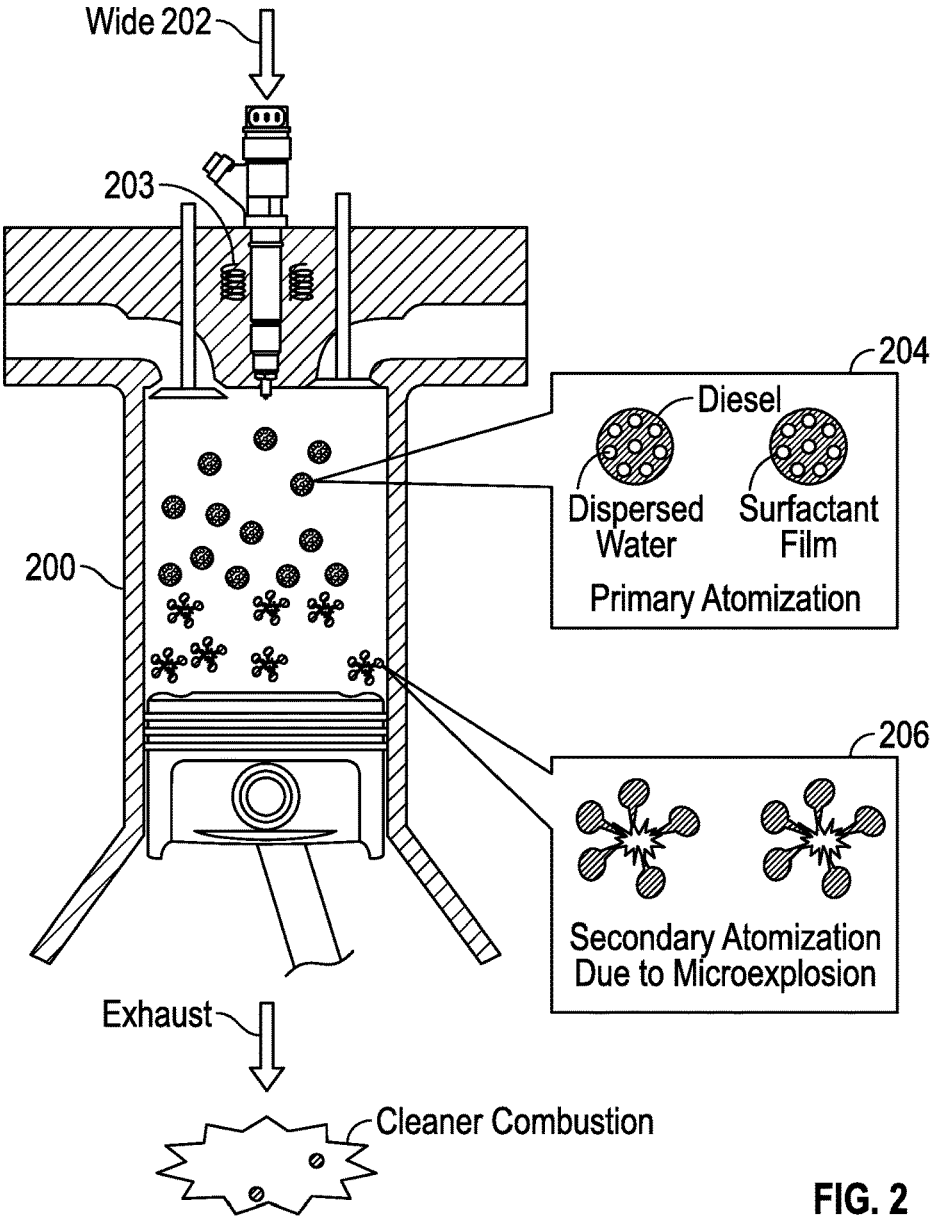
FIG. 2 is a schematic diagram illustrating primary and secondary atomization of a water-in-oil emulsified fuel within a combustion chamber in accordance with various embodiments.

FIG. 2 depicts an exemplary combustion chamber 200 into which an emulsified fuel 202, such as a water-in-diesel-emulsion (WiDE), is introduced through a nozzle (not shown). If desired, a heating element 203 may be used to raise the temperature of the emulsified fuel to within the range of 37-40° C. to facilitate auto-ignition. As seen, the water remains entrained within the diesel droplets due to the action of the surfactant. When this type of emulsion is sprayed into a hot combustion chamber, as shown in the first atomization stage 204, heat is transferred to the surface of the fuel droplets by convection and radiation. Since water and diesel have different boiling temperatures, the evaporation rates of these two liquids will be different. As a result, the water molecules reach their superheated stage faster than the diesel, resulting in micro-explosion and puffing in the second atomization stage 206. (See Current Trends at http://www.hindawi.com/journals/tswj/2014/5274720. In this context, micro-explosion refers to the whole droplet breaking up into small droplets quickly, while puffing refers to water leaving the droplets in a very fine mist.

Those skilled in the art will appreciate that the micro-explosion phenomenon in the second atomization stage is influenced by the volatility of the base fuel, the type of emulsion, and water content for both water-in-oil and oil-in-water emulsions.

In accordance with various embodiments of the present invention, an emulsified fuel product comprises a mixture of: i) fuel (50-90% by volume); ii) water (5-50%); and iii) other additives including surfactant (1-10%). These formulations will now be described in greater detail below.

A particularly preferred embodiment comprises the following components, expressed in approximate percentages by volume, added together to form the emulsified fuel product:

1) Diesel (70%)
2) Water (25%)
3) Naphtha (1.5%)
4) 2-ethlyhexalnitrate, isopropyl nitrate, or equivalent (1.5%)
5) Surfactant (2%)

The diesel component can be any type of diesel fuel, such as diesel #2, diesel fuel #6 (aka as bunker c), and heavy fuel oil (HFO). The naphtha and nitrates are believed to lower the flash point of the diesel and promote auto-ignition, and can each vary from 0.5 to 2.5% by volume. Those skilled in the art will appreciate that many diesel and other oils and fuels useful in the context of the present invention may already include up to 5% naphtha; nonetheless, the present inventor has found it desireable to add additional naphtha to the emulsified fuel product as set forth above.

The surfactant is selected based on, inter alia, an HLB value in the range of 7 to 10, and preferably about 8.8, and most preferably 8.75 or 8.83, which is believed to generally indicate the border spanning the oil-in-water and the water-in-oil portion of the HLB spectrum. Suitable surfactants for use in the present invention include ethoxylated alcohols such as Tomadol 91-2.5 (HLB 8.5) and Tomadol 1-3 (HLB 8.7) (available from Air Products at http://www.airproducts.com/products/product-finder/product-list/tomadol-45-13.aspx?itemId=B39B5CE5843CO8CAEAB8BE73866-C7&itemType=tn and http://www.airproducts.com/~/media/Files/PDF/industries/indus trial-and-institutional-cleaning-tomadol-ethoxylated-alcohols-product-guide.pdf, the entire contents of which are hereby incorporated by this reference). Other suitable surfactants include Tomadol 23-3 (HLB 7.9), Tomadol L80 (HLB 8), Tomadol 400 (HLB 8.9), Nonidet SF-3 (HLB 9), and Nonidet SF-5 (HLB 8), also available from Air Products, and PEG-8 Diolate (HLB 8), Sorbitan Laurate (HLB 8.6), PEG-40 Sorbitan Peroleate (HLB 9), Laureth-4 (HLB 9.7), and Lecithin (HLB 9). It is also desirable to select a detergent-based surfactant for use in the context of the present invention.

Figure 3:
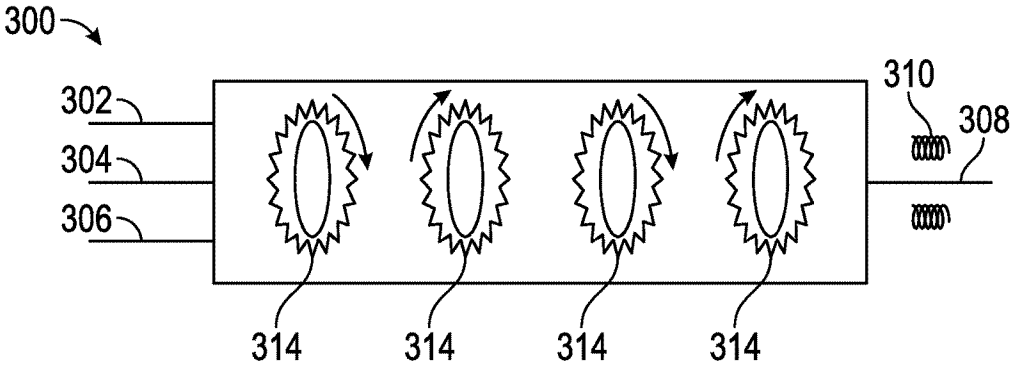
FIG. 3 is a schematic block diagram of a mixing chamber in which water, fuel, and surfactant are simultaneously mixed together to form emulsified fuel in accordance with various embodiments.

Referring now to FIG. 3, a single stage mixing chamber 300 includes a plurality of mixing blades 314 which may be configured to rotate in opposite directions. A first input conduit 302 is configured to introduce fuel; a second input conduit 304 is configured to introduce water; and a third input conduit 306 is configured to introduce one or more additives such as a surfactant. The blades mix the fuel, water, and surfactant into an emulsion, which is pumped from the mixing chamber through an output conduit 308. In an on demand type system, the output conduit 308 may be configured to supply emulsified fuel directly into one or more combustion chambers. If desired, an in-line heating element 310 may be configured to raise the temperature of the emulsion to approximately 36-42° C., and preferably about 39° C., to facilitate auto-ignition.

The mixing chamber shown in FIG. 3 is referred to as a single stage chamber, inasmuch as the flow of material through the chamber is substantially continuous, notwithstanding the presence of multiple mixing elements (e.g., blades). In contrast, various embodiments of the present invention contemplate a two stage mixing system, wherein the mixture is subject to a predetermined dwell time between the first and second mixing stages.

Figure 4:
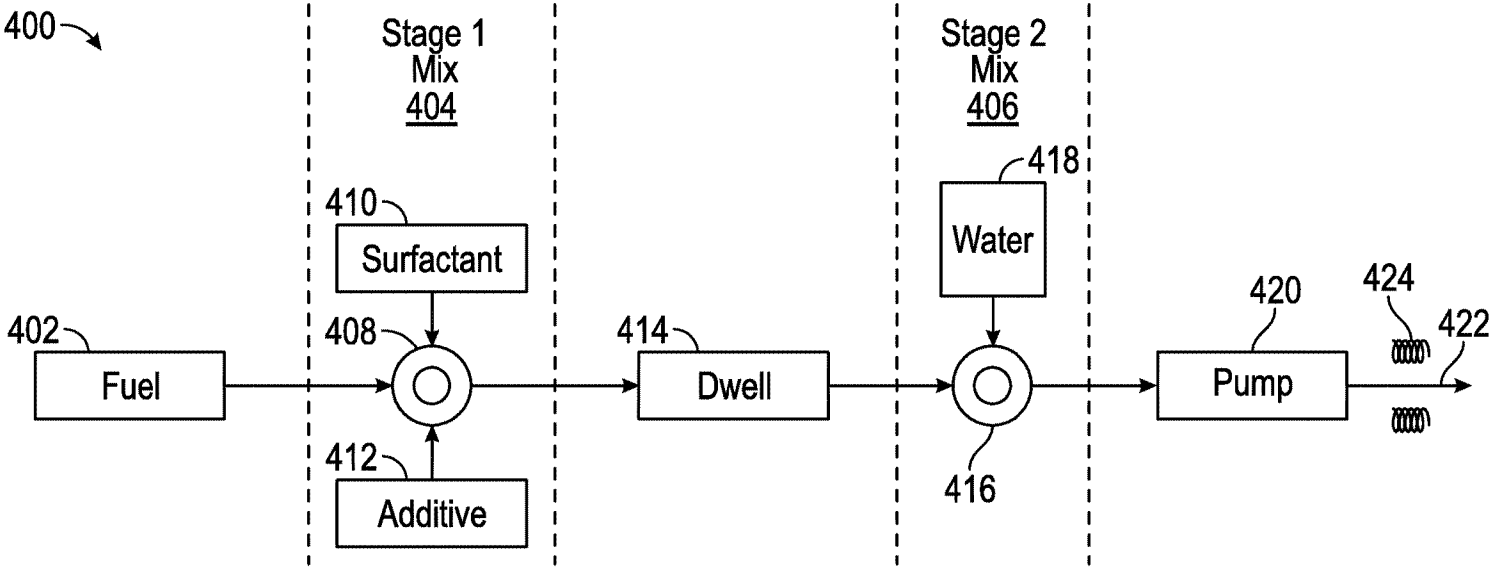
FIG. 4 is a schematic block diagram of a two stage mixing system in which fuel and surfactant are first mixed together, followed by the addition of water in accordance with various embodiments.

More particularly and referring now to FIG. 4, a multi-stage mixing system 400 includes a first stage mixing module 404 in which fuel is mixed with surfactant, and a second stage mixing module 406 in which water is introduced into the fuel/surfactant mixture.

In particular, mixing system 400 includes a fuel supply 402, a surfactant supply 410, and an optional additive supply 412. A standard laboratory mixer 408 is suitably equipped with a dissolver blade; alternatively, a dispersion or propeller type blade configuration may be employed to produce the high sheer interaction needed to blend the surfactant with the fuel. The surfactant (as described above), fuel, and optional additive (e.g., naphtha and/or nitrate) are mixed together in the first mixer 408 until the surfactant is suspended in the fuel, for example at a rate in the range of 800-16—RPM, and preferably about 1000-1200 RPM for 3 to 25 minutes, and preferably about 12 to 15 minutes.

Following the first mixing stage, the air is permitted to settle out of the solution for a dwell time in the range of less than 1 to about 30 minutes, and preferably about 3 to 5 minutes at ambient temperature and pressure. An in-line or other dwell chamber 414 may be used for this purpose.

Following the settling of the air bubbles, water from a water supply 418 is mixed with the fuel/surfactant in a second mixer 416, for example at a rate in the range of 800-16—RPM, and preferably about 1000-1200 RPM for 3 to 25 minutes, and preferably about 12 to 15 minutes. It will be appreciated that the first and second stage mixing chambers 408, 416 may comprise the same or different structures; that is, the blended surfactant and fuel may be reintroduced back into the same mixer following dwell to be mixed with the water.

A pump 420 may then be used to urge the resultant emulsified fuel through an output conduit 422 into a storage or transportation container or, in an on-demand system, directly into the combustion chamber (not shown). If desired, a heating element 424 may be used to raise the temperature of the emulsified fuel to a range of approximately 36-40° C.

Figure 5:
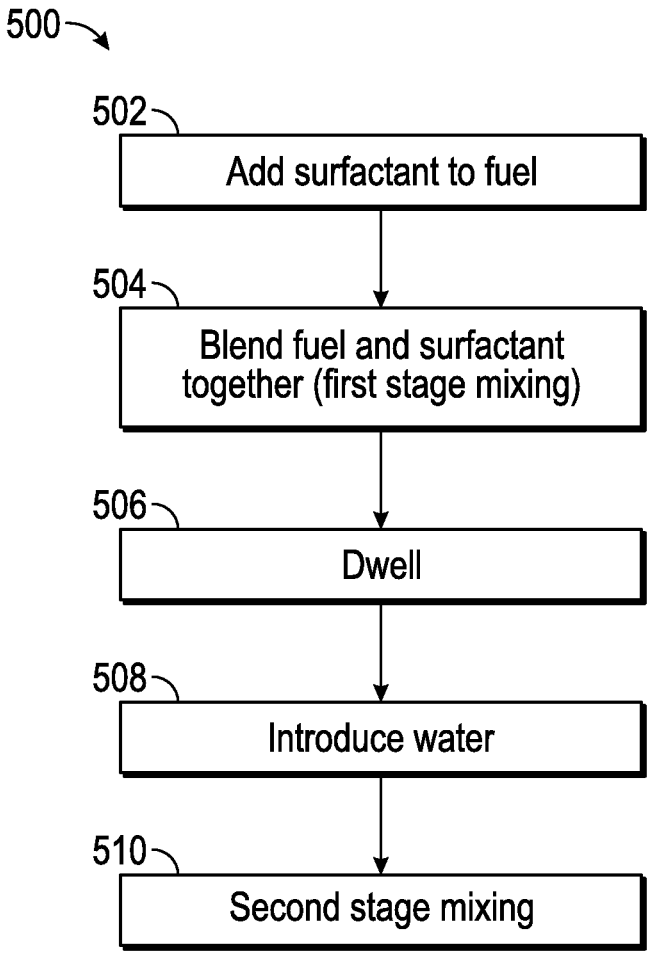
FIG. 5 is a process flow diagram of a two stage mixing method for producing emulsified fuel in accordance with various embodiments.

Referring now to FIG. 5, a flow chart illustrates an exemplary process 500 for manufacturing emulsified fuels in accordance with the present invention.

More particularly, the process 500 includes adding the surfactant to the fuel (Task 502), and mixing, agitating, or otherwise blending the fuel and surfactant together, for example in a sheering motion comprising the first stage mixing (Task 504). Following the first stage mixing of the surfactant and fuel, the mixture undergoes a dwell (Task 506) to allow entrained air to be removed from the mixture.

With continued reference to FIG. 5, water is introduced (Task 508) into the mixture, whereupon the water/fuel/surfactant combination undergoes a second stage mixing (Task 510).

A method of manufacturing emulsified fuel is thus provided. The method includes: adding a predetermined quantity of a surfactant to a predetermined quantity of a fuel component; blending the surfactant and fuel together in a first mixing chamber for a first mixing period; subjecting the blended surfactant and fuel mixture to a dwell period following the first mixing period; introducing water into the blended surfactant and fuel mixture following the dwell period; and blending the surfactant, fuel, fuel and water together in a second mixing chamber for a second mixing period.

In an embodiment, the first mixing chamber is different from the second mixing chamber; alternatively, the first and second mixing chambers may comprise the same chamber.

In an embodiment, the first mixing period is in the range of about 3 to 5 minutes and the dwell period is in the range of about 1 to 5 minutes.

In an embodiment, the first mixing chamber comprises a sheering blade operating in the range of about 1000 to 1200 RPM.

In an embodiment, the surfactant has a hydrophilic-lipophilic balance (HLB) value selected to promote complete combustion and extended shelf life.

In an embodiment, the HLB value is in the range of about 7 to about 10, and preferably about 8.7 to about 8.9.

In an embodiment, blending the surfactant and fuel together further comprises blending the surfactant and the fuel with naphtha in the range of about 0.5 to 2% by volume and nitrate in the range of about 0.5 to 2% by volume.

In an embodiment, the nitrate comprises at least one of one of 2-ethlyhexalnitrate and isopropyl nitrate.

In an embodiment, the emulsified fuel comprises: about 60% to 80% of the fuel component; about 20% to 30% of the water component; and about 0.5% to 5% of the surfactant component.

In an embodiment, the surfactant comprises a detergent and/or an ethoxylated alcohol.

In an embodiment, the surfactant comprises an HLB value of 8.7 to 8.8 and comprises about 2% by volume of the emulsified fuel.

In an embodiment, the fuel component comprises one of diesel #2, diesel #6, and heavy fuel oil (HFO).

In an embodiment, the surfactant, the first mixing period, the dwell period, and the second mixing period are selected to yield a shelf life for the emulsified fuel of at least 3 months.

An emulsified fuel is also provided having a volumetric mixture of: 1) 60%-80% diesel fuel component; 2) 15%-30% water; 3) 0.5%-2.5% naphtha; 4) 0.5%-2.5% of either 2-ethlyhexalnitrate, isopropyl nitrate, or equivalent nitrate; and 5) 1%-3% surfactant having an HLB rating in the range of 8.5-9.

In an embodiment, the diesel fuel is first blended with the surfactant in the absence of water, whereupon the water is thereafter introduced into the blended diesel fuel and surfactant mixture to form the emulsified fuel.

An apparatus is also provided for producing a water-in-oil emulsified fuel. The apparatus includes: a first stage mixing chamber configured to blend 0.5%-5% by volume of a surfactant having an HLB value in the range of 7 to 10 with 60%-90% by volume of a combustible oil to disperse the surfactant within the oil; a dwell chamber configured to allow the blended surfactant and oil to settle for up to 30 minutes following blending of the oil and surfactant together; and a second stage mixing chamber configured to blend the settled surfactant and oil mixture with 10%-35% by volume of water.

In an embodiment, the first stage mixing chamber is further configured to blend naphtha and nitrate with the fuel and surfactant.

As used herein, the word "exemplary" means "serving as an example, instance, or illustration." Any implementation described herein as "exemplary" is not necessarily to be construed as preferred or advantageous over other implementations, nor is it intended to be construed as a model that must be literally duplicated.

While the foregoing detailed description will provide those skilled in the art with a convenient road map for implementing various embodiments of the invention, it should be appreciated that the particular embodiments described above are only examples, and are not intended to limit the scope, applicability, or configuration of the invention in any way. To the contrary, various changes may be made in the function and arrangement of elements described without departing from the scope of the invention.

The invention claimed is:

1. A method of manufacturing and delivering a water-in-diesel-emulsion (WiDE) to a combustion chamber, comprising:

adding a predetermined quantity of a surfactant having a hydrophilic-lipophilic balance (HLB) value in the range of about 7 to 10 to a predetermined quantity of diesel fuel;

blending the surfactant and diesel fuel together in a first mixing chamber;

subjecting the blended surfactant and diesel fuel mixture to a dwell period of about 1 to 5 minutes following the first mixing period;

following the dwell period, transferring the blended surfactant and diesel fuel mixture to a second mixing chamber different than the first mixing chamber;

introducing water into the blended surfactant and diesel fuel mixture in the second mixing chamber following the dwell period;

blending the surfactant, diesel fuel, and water together in the second mixing chamber; and pumping the twice-blended diesel fuel mixture from the second mixing chamber to the combustion chamber through an in-line heater;

wherein the in-line heater is configured to adjust the temperature of the fuel mixture to a range of 37-40° C.; and wherein the fuel component comprises one of diesel #2, diesel #6, and heavy fuel oil (HFO).

2. The method of claim 1, wherein the first mixing period is in the range of about 3 to 5 minutes.

3. The method of claim 2, wherein the first mixing chamber comprises a sheering blade operating in the range of about 1000 to 1200 RPM.

4. The method of claim 1, wherein the HLB value is in the range of about 8.7 to about 8.9.

5. The method of claim 1, wherein blending the surfactant and fuel together further comprises blending the surfactant and the fuel with naphtha in the range of about 0.5 to 2% by volume and nitrate in the range of about 0.5 to 2% by volume.

6. The method of claim 5, wherein the nitrate comprises at least one of one of 2-ethlyhexalnitrate and isopropyl nitrate.

7. The method of claim 1, wherein the emulsified fuel comprises:

about 60% to 80% of the fuel component;

about 20% to 30% of the water component; and about 0.5% to 5% of the surfactant component.

8. The method of claim 1, wherein the surfactant comprises a detergent.

9. The method of claim 1, wherein the surfactant comprises an ethoxylated alcohol.

10. The method of claim 9, wherein the surfactant comprises an HLB value of 8.7 to 8.8 and comprises about 2% by volume of the emulsified fuel.

11. The method of claim 1, wherein the surfactant, the first mixing period, the dwell period, and the second mixing period are selected to yield a shelf life for the emulsified fuel of at least 3 months.

* * * * *